United States Patent [19]

Strickland et al.

[11] Patent Number: 4,570,896

[45] Date of Patent: Feb. 18, 1986

[54] SLIDE ACTION INSIDE CORNER FORM

[75] Inventors: James K. Strickland; H. Grady Ivey, both of Jacksonville, Fla.

[73] Assignee: Strickland Systems, Inc., Jacksonville, Fla.

[21] Appl. No.: 577,356

[22] Filed: Feb. 6, 1984

[51] Int. Cl.[4] ..... B28B 7/30

[52] U.S. Cl. ..... 249/27; 249/152; 249/180; 249/184; 249/194

[58] Field of Search ..... 249/27, 178, 180, 152, 249/184, 185, 186, 194

[56] References Cited

U.S. PATENT DOCUMENTS

| | | | |
|---|---|---|---|
| 2,827,683 | 3/1958 | Benart et al. | 249/180 |
| 3,476,351 | 11/1969 | Burdett | 249/181 |
| 3,570,802 | 3/1971 | Miller | 249/152 |
| 3,841,596 | 10/1974 | Cull | 425/65 |
| 3,844,526 | 10/1974 | McCracken | 249/152 |
| 3,934,808 | 1/1976 | Alzawa | 249/27 |
| 3,989,439 | 11/1976 | Schmitzberger | 249/184 |
| 4,088,296 | 5/1978 | Armas | 249/180 |
| 4,252,291 | 2/1981 | Armas | 249/184 |
| 4,447,035 | 5/1984 | Ivey et al. | 249/185 |

*Primary Examiner*—Jay H. Woo
*Assistant Examiner*—James C. Housel
*Attorney, Agent, or Firm*—Banner, Birch, McKie & Beckett

[57] ABSTRACT

A concrete form unit for casting an inside corner structure has a pair of form panels disposed generally perpendicular to each other and an elongated corner member disposed between spaced adjoining edges of such panels with an actuator having relatively movable parts including a first part connected to the midsection of a yoke and a second part connected to the corner member. The ends of the yoke are guidingly connected to the form panels, respectively, and the adjoining edges of the form panels are guidingly coupled to opposite sides of the corner member by slidingly interengaging surfaces, these surfaces defining a tapered wedge where the corner member mates with the adjoining edges of the form panels.

6 Claims, 5 Drawing Figures

SLIDE ACTION INSIDE CORNER FORM

INVENTION FIELD

The invention herein relates generally to concrete form work. More particularly, it is directed to improvements in automatically operated form units usable to cast the inside surfaces of a corner as may be required in forming a tubular concrete structure such as a shaft, box culvert, etc.

BACKGROUND OF THE INVENTION

There are many different proposals in the prior art for concrete form work and assembly or its components, either manually or with some degree of automation, into functional units for concrete construction. Apparatus of various forms has been suggested to facilitate the positioning of concrete form panels for the specialized situation required in the casting of an inside corner that is to form a part of a concrete wall structure. The necessity for inside corner concrete casting obviously arises in the construction of concrete shafts for elevators, stairwells and, indeed, many other tubular concrete structures such as box culverts, etc.

It is important in the casting of inside corners, as well as other concrete structures, to achieve a smooth surface free from joint lines once the form panels and associated components are stripped from the hardened cast concrete. Similarly, it is important that the concrete casting apparatus that is utilized be of as simple construction as possible, involving a minimum number of structural elements and certainly avoiding the necessity for use of a variety of detachable or detached elements which would be readily subject to becoming separated or lost from the overall apparatus such as to prevent reuse of the apparatus at a multiplicity of different site locations.

Many of the prior art apparatus assemblies have been unable to achieve the above explained desired attributes of providing a unitized apparatus which can be automatically operated simply and effectively in the casting of inside surfaces of a concrete corner. Such simple and effective automatic operation necessarily involves both setting up the form panels and related components preliminary to concrete pouring and thereafter the stripping of these panels and components from the hardened concrete structure.

A principal object of this invention is to provide a form unit usable to cast the inside surfaces of a corner which is capable of forming smooth inner surfaces at and adjacent the inside corner with the form unit being effectively automatic both in setting up and in stripping the form panels and components against which concrete is poured.

Another significant object of the invention is to provide a unitized concrete form unit for inside corner casting which is self-contained so that all elements making up the form unit may be automatically manipulated, essentially without independent support for any of the elements making up the concrete form unit.

It is a further object of the instant invention to provide an inside corner form unit which is totally automated, simple in construction with a minimum of interrelated components and is easily subject to being operated hydraulically by means of any suitable hydraulic pressure source.

An additional object of this invention is to provide an inside corner form unit wherein automated operation enables the unit to be set up for initial concrete pouring followed by stripping the form panels disposed adjacent the inside corner and a corner member from the cast inside corner, all of the components making up the form unit being integrated into a unitary assembly wherein the components are tied together generally in a circular or ringlike arrangement with the actuator for the form unit acting diametrically within this ring-shaped integrated assembly of components.

SUMMARY OF THE INVENTION

In brief, the invention embodies an integrated form unit for inside corner casting to be utilized in construction of various tubular-like concrete structures. The apparatus has a pair of form panels disposed generally perpendicular to each other and an elongated corner member disposed between spaced adjoining edges of these form panels with an actuator having relatively movable parts including a first part connected to the midsection of a yoke and a second part connected to the corner member. The ends of the yoke are guidingly connected to these form panels, respectively, and the spaced adjoining edges of the form panels are guidingly coupled to opposite sides of the corner member, preferably by sliding interengagement of surfaces defining a tapered wedge where the corner member mates with the adjoining edges of the form panels.

By coupling the side surfaces of the tapered wedge on the corner member to the guide surfaces formed by the spaced adjoining edges of the form panels and further by guidingly connecting the yoke to the form panels, an integrated relationship between the components into a ring-shaped assembly is obtained. With this ring-shaped arrangement an axially extensible actuator can effectively be employed with this actuator being disposed diametrically within the ring-shaped arrangement. Accordingly, the concrete form unit can have the corner member and form panels shifted into a casting condition whereat the casting faces of the form panels and corner member are contiguous with one another. Similarly, by contracting the actuator the ring-shaped arrangement of components can be collapsed, thereby effectively acting to strip these casting faces from the hardened concrete which was previously poured thereagainst.

Preferably, the actuator for the concrete form unit is energized through utilization of a pressurized hydraulic fluid. This has the advantage of being able to easily conduct the pressurized fluid to one or several actuators located in confined positions where manual access could be difficult. Conventional hydraulic hoses can be led from these actuators to the pressurized hydraulic fluid source.

Where the simultaneous casting of all inside surfaces of a tubular concrete structure is desired, four of the concrete form units are assembled into a box configuration. When using this box configuration, supplemental form panels may or may not be utilized disposed intermediate adjacent inside corner form units. In this manner the outwardly facing walls of this box configuration effectively serve to define the inside surfaces of the desired concrete structure to be cast.

BRIEF DESCRIPTION OF THE DRAWINGS

The foregoing objects, as well as others, will become apparent through consideration of the following detailed description of the invention given in connection with the accompanying illustrations on the attached drawings in which.

DETAILED DESCRIPTION OF AN ILLUSTRATIVE EMBODIMENT

Figure 1:
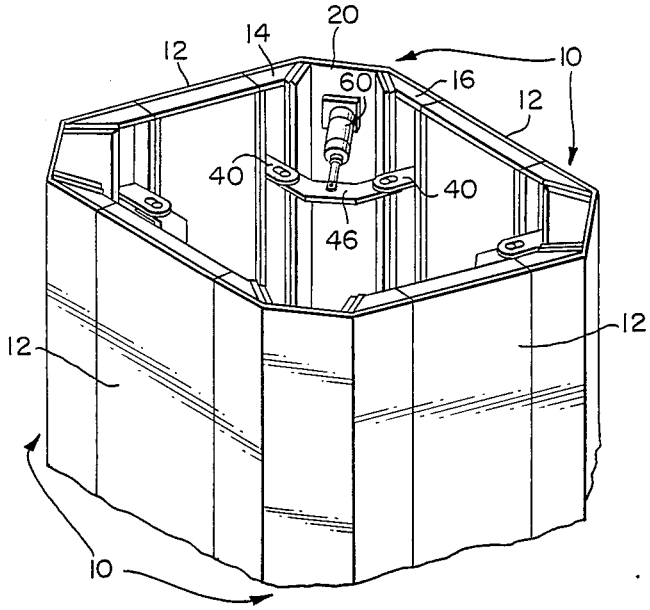
FIG. 1 is a partial diagrammatic perspective view showing four inside corner form units of the invention assembled with intermediate form panels about which a tubular concrete structure would be cast.

On FIG. 1 of the drawings, four inside corner units 10 embodying the invention are shown assembled into a box configuration by these form units being bolted together with four intermediate form panels 12. The assembly of this box configuration provides outwardly facing walls to define the inside surfaces of a tubular concrete structure, such as a box culvert, when concrete is poured around the box configuration.

Obviously, exterior form panels (not shown) will be suitably mounted in accordance with conventional concrete form work techniques with these exterior form panels being spaced outwardly of the box configuration walls. The extent of spacing between such exterior form panels and the outwardly facing walls of a box configuration obviously will establish the concrete wall thickness for the tubular concrete structure.

It will be readily recognized that the dimensions of the assembled box configuration, such as shown on FIG. 1, may be easily varied depending upon the particular dimensions desired for the tubular concrete structure that is to be cast. For example, two or all of the intermediate form panels 12 may be omitted. With the omission of intermediate panels 12, the four form units 10 would simply have their adjoining edges directly bolted together. Likewise, it will be recognized that the width dimensions of the intermediate form panels 12 may be varied as is desired in order to generate the particular dimensions for the assembled box configuration needed for a particular size tubular concrete structure to be cast.

It will also be understood that the particular external shape, size or wall thickness of the tubular concrete structure that is cast will be determined by the particular exterior form panels (not shown) as they are mounted and secured spaced outwardly of the outer casting faces of the assembled box configuration of FIG. 1. It might be mentioned that the particular construction of the individual form panels themselves can take a variety of forms, all as recognized in accordance with more or less conventional practices in the concrete form work construction field. The manner in which each form panel is constructed is not considered an essential part of the instant invention.

While not intended to be at all limiting on the invention, in a sample illustration, each inside corner form unit 10, as well as the associated intermediate form panels 12, if such are employed, may be constructed to have an eight-foot length with a form unit 10 providing a width in the order of 24 inches extending from the virtual corner that is being cast. In the embodiment shown the form unit 10 has its corner member defining a diagonal casting face bridiging the space between the adjoining edges of the two form panels making up the corner unit 10. Obviously, longer or shorter lengths and/or widths for the form units 10 may be adopted depending on the needs for the particular concrete structure to be cast.

In adopting the above-mentioned eight-foot length for the concrete form units 10, it has been found appropriate to utilize similar assemblies, each including an actuator, yoke, brackets and related parts, adjacent both the upper and lower ends of each form unit 10. Taking this approach, a single hydraulic piston-cylinder operator can be used with each of these similar assemblies located at the upper and lower ends of each form unit 10.

Figure 2:
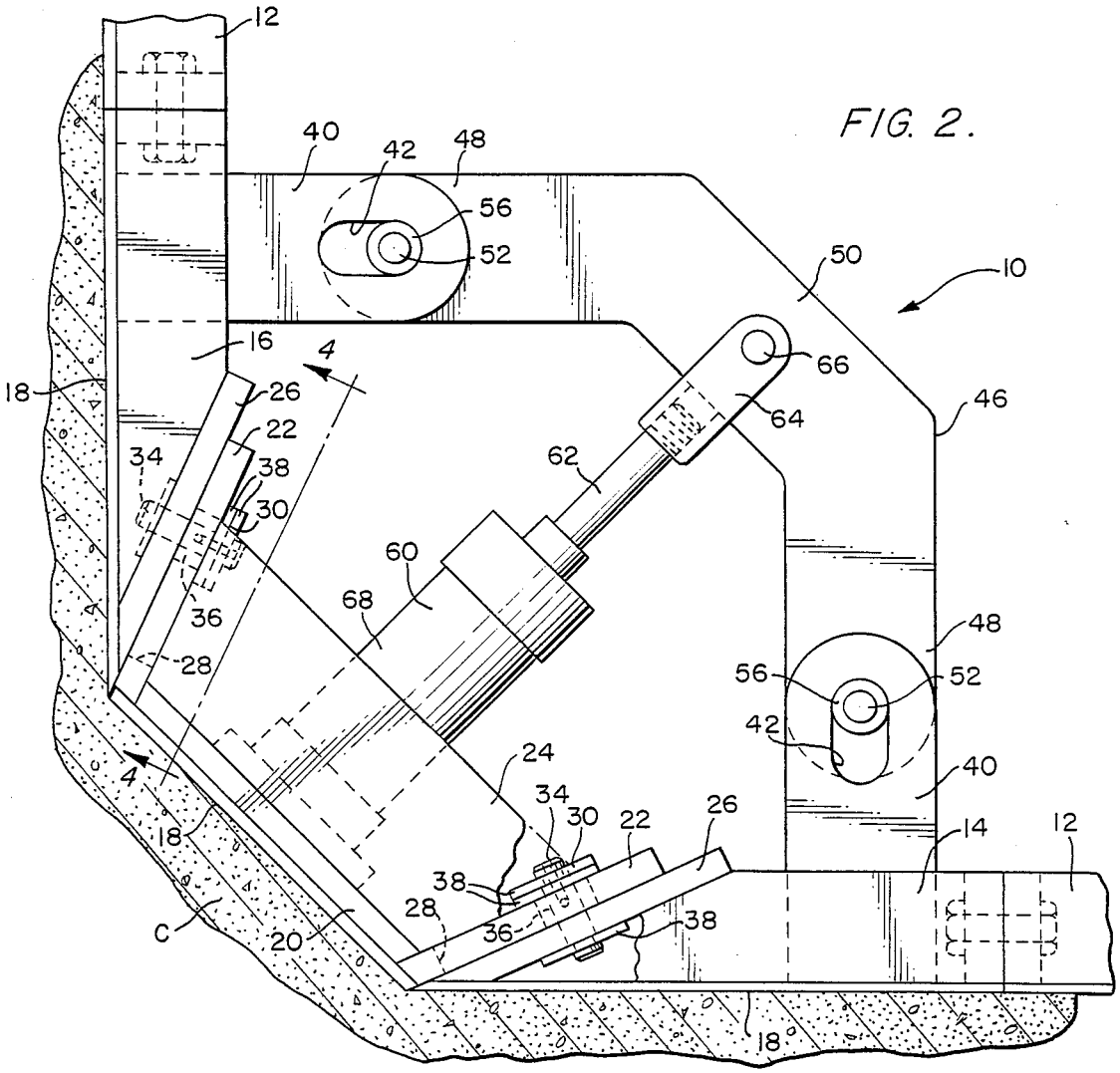
FIG. 2 is a plan view showing an inside corner form unit of the invention with segments of adjacent intermediate panels and a segment of concrete cast on the exterior casting faces of the form unit and intermediate panels.
Figure 3:
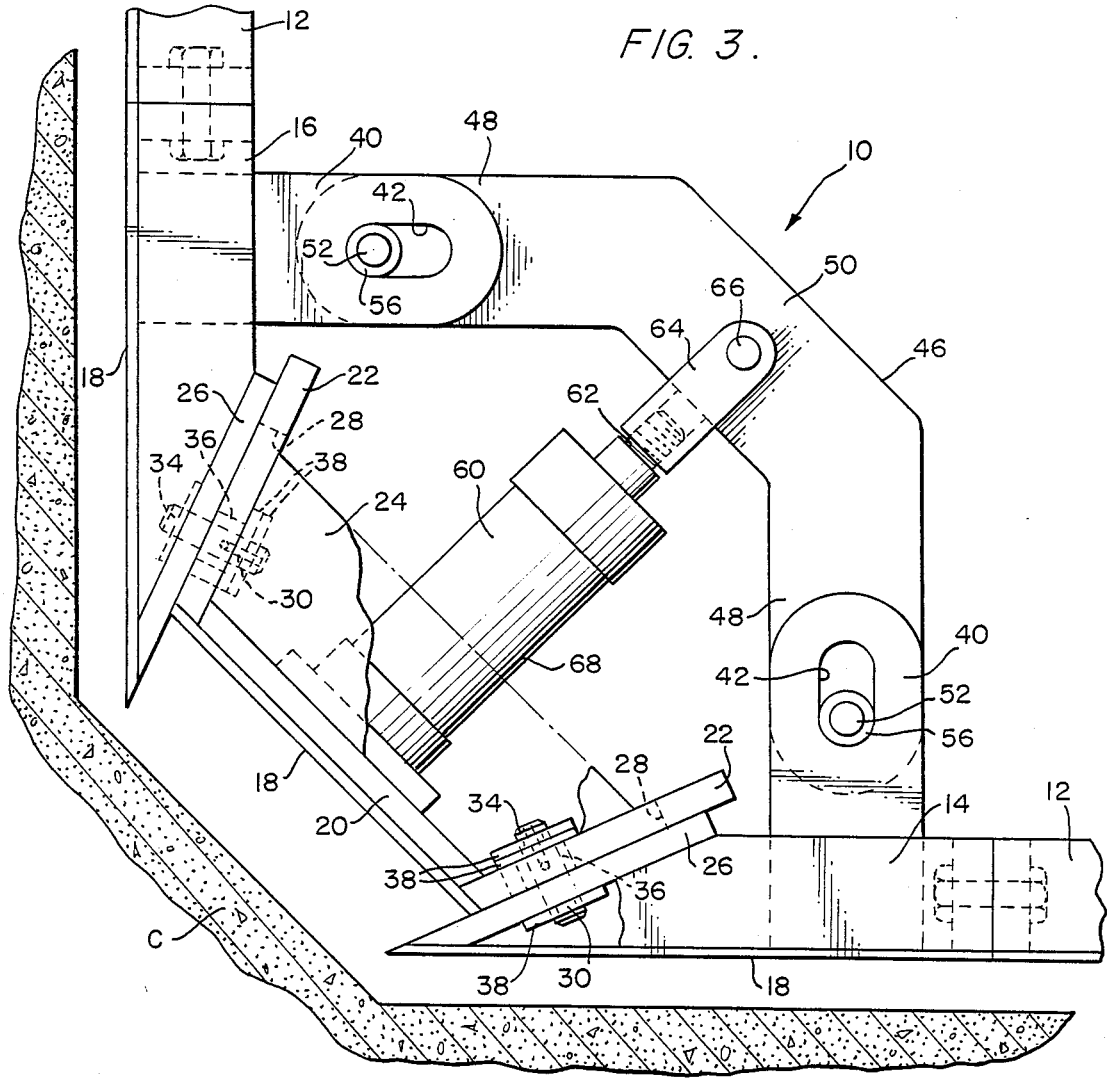
FIG. 3 is a view similar to FIG. 2, but showing the inside corner form unit after the casting faces have been stripped from the hardened concrete.

The integrated unitary relationship of the components making up each inside corner form unit 10 may best be understood by reference to FIGS. 2 and 3. However, FIG. 1 does basically illustrate, in perspective, one assemblage of these components supported on the interior of the assembled box configuration shown on FIG. 1.

Each form unit 10 has a pair of form panels 14 and 16 which provide a pair of external casting faces 18 disposed generally perpendicular to each other. An elongated corner member 20 is disposed between the adjoining edges of form panels 14 and 16. Member 20 provides a third external casting face 18 which bridges the space between the adjoining edges of form panels 14 and 16. Thus, the concrete C is cast against the outwardly facing external casting faces 18 of the form panels 14 and 16, and corner member 20.

In the configuration illustrated on the drawings, the elongated corner member 20 has a cross-section defined by sidewalls 22 joined by a center web 24 that forms a gusset extending between the sidewalls 22. The surfaces of these sidewalls 22 define a tapered wedge to provide the corner member 20 with opposite side surfaces.

In turn, each form panel 14 and 16 is provided with a bearing plate 26 welded diagonally of the panel end adjacent the corner member 20 so that the spaced adjoining edges of panels 14 and 16 have their edges provided with opposed guide surfaces defined by the faces of these bearing plates 26. The guide surfaces of plates 26 are slidingly interengaged with the opposite side surfaces that are provided by the outer faces of sidewalls 22 on corner member 20.

The preferred angle relationship of the side surfaces on the tapered wedge of corner member 20 provided by the sidewalls 22 and of the guide surfaces on the bearing plates 26 of form panels 14 and 16 relative to their respective casting faces 18 is considered important. The optimum angle relationship is shown by the embodiment illustrated on FIGS. 2 and 3.

In this preferred embodiment, the guide surface defined by the face of bearing plate 26 is disposed at a 25° angle relative to the casting face 18 on each of the form panels 14 and 16. Likewise, the tapered wedge provided by the outer faces of sidewalls 22 on corner member 20 includes an angle of 40°, this included angle resulting by each sidewall 22 being inclined at an angle of 20° relative to the axis of the actuator means 60 for the corner form unit 10. This preferred angular relationship has been found to give advantageous operational characteristics to the form unit 10. In effect, the sliding interengagement between the mating surfaces of sidewalls 22 and bearing plates 26 with this angular relationship for the tapered corner member 20 provides highly effective operation when the corner member is moved relative to the form panels 14 and 16.

While the above angle relationship between the tapered wedge of corner member 20 and the diagonally disposed bearing plates 26 on form panels 14 and 16 is preferred, an included angle other than 40° may be employed in constructing the inside corner unit 10 if desired. Thus, an operable inside corner unit 10 could employ a tapered wedge on corner member 20 where the above defined included angle is as low as 30° or as large as 60°. Within this range of variation, the guide surfaces of plates 26 could be disposed as high as 30° relative to the casting faces 18 of the form panels 14 or 16 with the surfaces of sidewalls 22 on corner member 20 being disposed at an angle of 15° relative to the axis of the form unit 10 actuator means. Likewise, the guide surfaces of bearing plates 26 could form an angle of 15° with the casting faces 18 of form panels 14 or 16, whereupon the side surface of sidewalls 22 on corner member 20 would form an angle of 30° relative to the axis of the corner form unit 10 actuator means 60.

Figure 4:
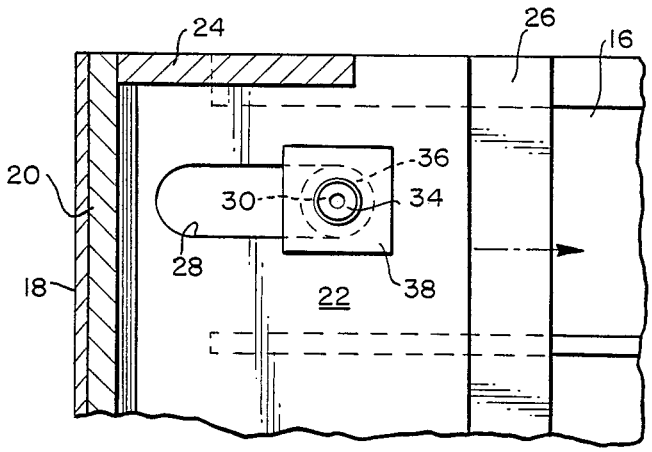
FIG. 4 is a broken-away sectional view taken on line 4—4 of FIG. 2.

The slidingly interengaged guide surfaces and side surfaces on the tapered wedge of corner member 20 are coupled by a pin and slot coupling. This coupling serves to maintain interengagement between the surfaces during relative movement between corner member 20 and the form panels 14 and 16. This pin and slot coupling, as described below, may be best visualized from FIGS. 4 and 5, although the couplings at opposite sides of the corner member are also shown on FIGS. 2 and 3.

Figure 5:
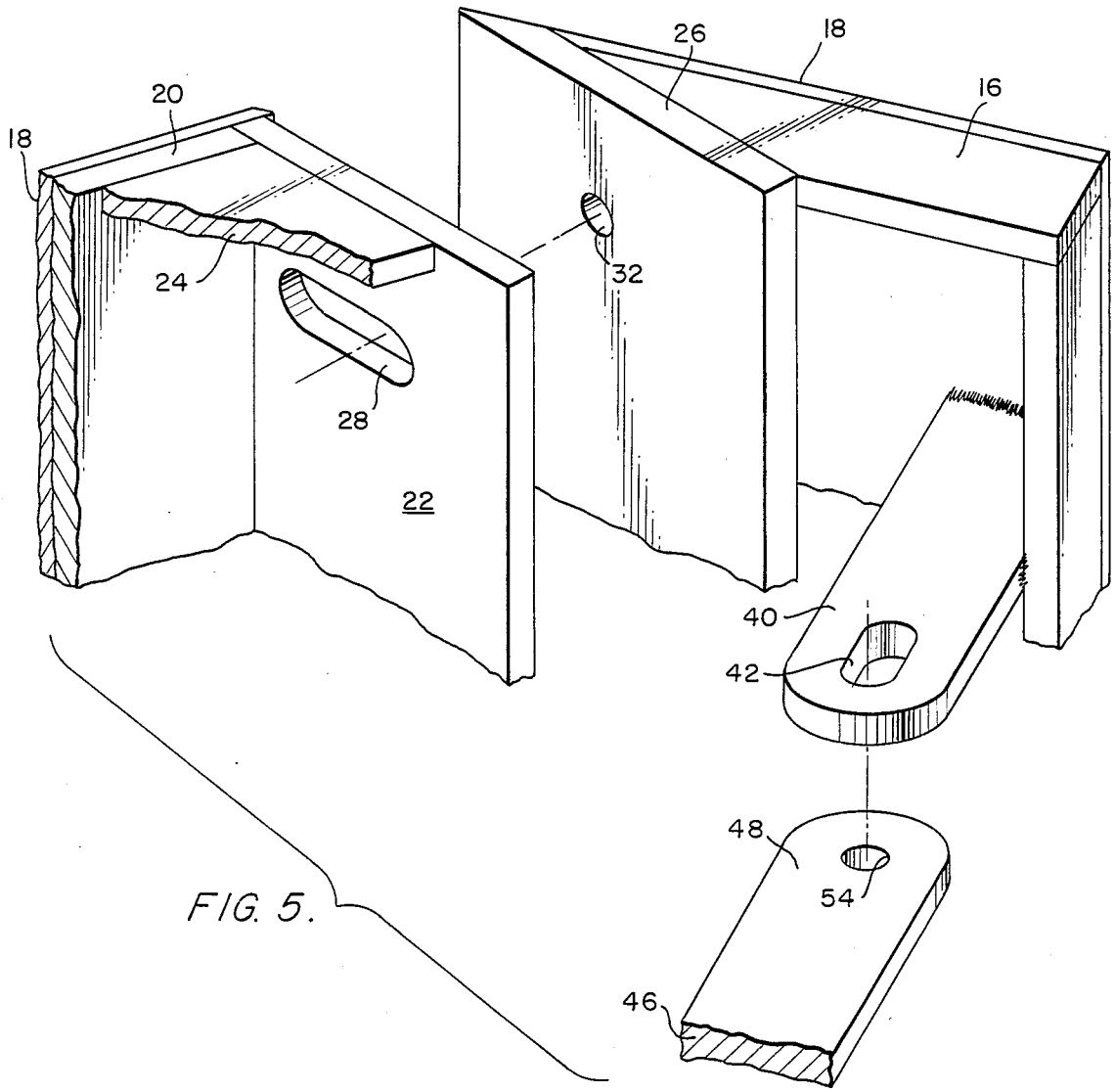
FIG. 5 is an exploded partial perspective view showing components of the form unit in disassembled relation.

The sidewall 22 on corner member 20 is formed with a guide slot 28. A pin means 30 is received in guide slot 28 with this pin means being carried by the bearing plate 26 on the edge of each of form panels 14 and 16. This pin means 30 may be mounted on bearing plate 26 by extending through a bore 32 (FIG. 5).

To form the coupling which maintains interengagement between the side surfaces on the tapered wedge provided by sidewalls 22 of corner member 20 and the guide surfaces provided by the surfaces of bearing plates 26, the pin means 30 preferably includes a supporting pin 34 on which is mounted an antifriction bearing 36. Appropriate washers 38 are received over the outer ends of supporting pin 34. The ends of pin 34 may be suitably formed or fixed to hold the pin means 30 with washers 38, antifriction bearing 36, side surface and guide surface firmly interengaged during relative movement between the corner member 20 and form panels 14 and 16. The pin 34 may take the form of a shoulder bolt and nut fastener (not shown) to maintain this firm interengagement of pin means 30.

It will be recognized that similar pin and slot couplings are employed at both sides of the tapered wedge on corner member 20, such as is clearly shown on FIGS. 2 and 3.

To maintain the antifriction bearing 36 lubricated and promote free sliding interengagement between the guide surfaces of bearing plates 26 on form panels 14 and 16, and the opposite side surfaces on the tapered wedge side walls 22 of corner member 20, each pin 34 may be centrally and laterally bored to have a grease fitting (not shown) threaded thereinto. Then, lubricating grease may be introduced into the pin 34 to promote free sliding between the interengaged surfaces and keep the antifriction bearing 36 well lubricated.

Each of the form panels 14 and 16 in a form unit 10 has a bracket 40 welded thereto so as to extend inwardly from the form panel casting face 18. Each of these brackets 40 is provided with an elongated slot 42. These slots 42 in brackets 40 are part of the guiding connection present in the form unit 10, taking the form of a pin and slot connection between the respective form panels 14 and 16, and a yoke 46, as will be explained.

Yoke 46 provides a pair of end sections 48 and a midsection 50. Each of the end sections 48 of yoke 46 carries a pin means which may be generally similar to the pin means 30 described hereinabove with respect to the coupling means in the form of a pin and socket coupling which maintains interengagement between the slidingly mating surfaces on the corner member 20 and respective form panels 14 and 16.

The pin means carried by the end section 48 of yoke 46 may thus consist of a supporting pin 52 which extends through a bore 54 (FIG. 5) in the end section 48 of yoke 46. An antifriction bearing 56 is mounted on this supporting pin 52 with the bearing perimeter being received in the elongated slot 42 of the bracket 40 fixedly secured to extend inwardly from each of the form panels 14 and 16.

The above-described guiding connection between the end sections 48 of yoke 46 and the brackets 40 that are fixedly secured to the form panels 14 and 16, respectively, insures that the yoke 46 is securely retained in proper captive relation to the form panels 14 and 16. Thus, the midsection 50 of yoke 46 provides a suitable location for application of actuator force to shift the corner member 20, and form panels 14 and 16 relative to each other to move the concrete form unit 10 from a casting condition such as is shown on FIG. 2 to a collapsed condition such as is shown on FIG. 3.

The actuator means for concrete form unit 10 is provided by a hydraulic piston-cylinder operator 60. With the form panels 14 and 16, elongated corner member 20, brackets 40 and yoke 46 interconnected by the coupling means and guiding connection means at their respective ends, the piston-cylinder operator 60 is mounted diametrically across this ring-shaped interconnection arrangement of the form unit 10 components. Thus, the rod 62 of operator 60 has a clevis 64 threaded onto the end of rod 62 with a pin 66 connecting the clevis 64 to the midsection 50 of yoke 46. Likewise, the cylinder 68 of operator 60 has its base appropriately mounted to the inside of corner member 20 as by bolts (not shown) or other suitable connection means.

It will be readily recognized that the piston-cylinder operator 60 will be supplied with appropriate hydraulic hose connections (not shown) whereby hydraulic fluid under pressure can be directed to one or the other ends of the cylinder 68 of operator 60 to extend rod 62 of operator 60 to its full length as shown on FIG. 2 or contract the operator 60 to the condition shown on FIG. 3, all such hydraulic controls, hose connectors, etc., being utilized in accordance with conventional hydraulic technology as known in the prior art. Accordingly, details of these controls, hoses, hydraulic connections, etc., are not shown nor need they be discussed herein.

Having described hereinabove all of the operating components of the concrete form unit 10 and having pointed out the integrated interconnected relationship between the components in the form of an integrated ring-shaped arrangement, explanation of the operation of the form unit 10 may now be readily understood. On FIG. 2 the form unit 10 is shown in its casting condition whereat the casting faces 18 on form panels 14 and 16, and on corner member 20, are contiguous with one another. Similarly, FIG. 3 shows the form unit 10 in its collapsed condition whereat the interconnected ring-shaped arrangement of components is drawn together by contraction of the hydraulic piston-cylinder operator 60.

In the casting condition of form unit 10 as shown on FIG. 2, the three casting faces on corner unit 20 and form panels 14 and 16 are contiguous with one another. In this condition, the perimeters of antifriction bearings 36 which are received in the guide slots 28 formed in the sidewalls 22 of corner member 20 are in engagement with the ends of these slots 28 that are remote from the casting face 18 of corner member 20. Similarly, in this casting condition for form unit 10 each of the antifriction bearings 56 which are received in the elongated slots 42 of brackets 40 carried by form panels 14 and 16 are in engagement with the ends of slots 42 remote from the casting face 18 of each form panel 14 or 16.

In this casting condition of unit 10, the ring-like arrangement of components is expanded to its maximum ring diameter, placing form unit 10 in a rigidly locked-open state in readiness for casting of concrete against the casting faces 18 of corner unit 10. After the fluid concrete C has been poured against the casting faces 18 into a state as suggested on FIG. 2, the poured concrete is permitted to harden after which the corner unit is to have its casting faces 18 stripped from the now-hardened concrete C. During this concrete hardening process the components of unit 10 remain in their locked-open condition, being held in such condition by the hydraulic piston-cylinder operator 60 forcing the form panels 14 and 16, and corner member 20, outwardly through force of operator 60 applied to yoke 46. This maintains the pin means 30 against the ends of slots 28 and the pin means including support pins 52 and antifriction bearings 56 maintained with the bearings snugly against the ends of slots 42 in brackets 40.

In carrying out the stripping operation after the concrete has hardened, the hydraulic piston-cylinder operator 60 is contracted by application of appropriate hydraulic fluid pressure tending to shift the operator 60 into its contracted condition as shown on FIG. 3. Incident contraction of operator 60 the corner member 20 is pulled back with the pin means 30 maintaining the tapered wedge surfaces of corner member sidewalls 22 in interengagement with the guide surfaces on bearing plates 26 of the form panels 14 and 16. While the casting face of corner member 20 is being stripped from the hardened concrete surface, the form panels 14 and 16 are also stripped from the hardened concrete, all under control of the pin and slot connection existing between brackets 40 and the end sections 48 of yoke 46.

When the form unit is fully contracted to the collapsed condition as shown on FIG. 3, the perimeter of each bearing means 36 will have shifted to be in engagement with the opposite ends of guide slots 28. Similarly, the perimeter of antifriction bearings 56 will have shifted to be snugly in engagement with the opposite ends of elongated slots 42 in the brackets 40. Thus, similar to the locked condition which the form unit assumed under the extension forces of operator 60 in FIG. 2, now the form unit, in its collapsed condition as shown in FIG. 3, has a locked-closed state. The corner member 20 has been drawn back to its maximum position relative to the form panels 14 and 16, being limited by the bearings 36 snugly engaging in the ends of guide slots 28 formed in the sidewalls 22 of member 20. Similarly, the bearings 56 are snugly engaged in the ends of elongated slots 42 of brackets 40 so that yoke 46 has been drawn in to its maximum position relative to the form panels 14 and 16.

As mentioned above, it has not been felt necessary to enter into description or illustration of specific hydraulic controls appropriate to effect the desired operations of the hydraulic piston-cylinder operator 60 in carrying out the above-described movement or manipulation of the components of the inside corner form unit 10. These controls for appropriate handling of pressurized hydraulic fluid in hydraulic circuitry are known and can be appropriately designed by technology available in the art.

It should be recognized that although utilization of hydraulic piston-cylinder actuators and hydraulic fluid under pressure generally have desirable advantages for utilization with the form unit 10, other forms of actuators and power sources to provide the operating forces necessary for unit 10 may be used within the scope of the invention as it is contemplated.

It should also be observed that whereas in the description and drawing illustrations the operating assemblies for the form panels 14 and 16, and corner member 20, have been shown at only one end of corner unit 10; normally more than one of these assemblies will be employed, depending upon the overall length contemplated for the inside corner form unit 10. Particular advantages for the inside corner form unit 10 of this invention will be recognized by reason of its essentially self-contained nature and the capability for operation without independent support. Requiring such support could involve a separate scaffold or other ground supporting framework.

The powerful forces available by extension and contraction of the hydraulic-piston cylinder operator 60 are fully available to carry out the form stripping operation. With the coupling means and guiding connection means between the corner member, form panels 14 and 16, and yoke 46, the operator 60 effectively applies these forces against the yoke 46 while it is stripping the panels 14 and 16 from the hardened concrete C.

It should be obvious from the above-discussed apparatus embodiment that numerous other variations and modifications of the apparatus of this invention are possible, and such will readily occur to those skilled in the art. Accordingly, the scope of this invention is not to be limited by the embodiment disclosed, but is to include any such embodiments as may be encompassed within the scope of the claims appended hereto.

We claim:

1. A concrete form unit for casting an inside corner comprising:

a pair of form panels providing external casting faces disposed generally perpendicular to each other, said panels defining spaced adjoining edges therebetween which edges provide opposed guide surfaces;

an elongated corner member disposed between said adjoining edges of said form panels, said member providing an external casting face bridging the space between said adjoining edges and having opposite side surfaces defining a tapered wedge on said corner member, said wedge having an acute angle included between said opposite side surfaces with the taper of said wedge converging toward said external casting face of said corner member, said side surfaces being slidingly interengaged with said guide surfaces on said form panels;

means coupling said side surfaces of said tapered wedge to said guide surfaces to maintain sliding interengagement between said surfaces during relative movement between said corner member and said form panels, said coupling means including a pin and slot coupling between each pair of interengaged surfaces;

yolk means having a pair of end sections with each end section being guidingly connected to one of said form panels by a pin and slot connection between each yolk means end section and one of said form panels;

a bracket extending inwardly of the form panel casting face carried by each of the said form panels, said pin and slot connection being formed by one of said bracket and said end section being provided with an elongated slot and the other of said bracket and said end section carrying pin means received in said elongated slot; and actuator means having relatively movable parts including a first part connected to the midsection of said yolk means and a second part connected to said corner member whereby relative movement between said parts causes said corner member and said form panels to shift said concrete form unit from a casting condition whereat said casting faces are contiguous with one another to a collapsed condition.

2. A concrete form unit for casting an inside corner comprising:

a pair of form panels providing external casting faces disposed generally perpendicular to each other, said panels defining spaced adjoining edges therebetween which edges provide opposed guide surfaces;

an elongated corner member disposed between said adjoining edges of said form panels, said member providing an external casting face bridging the space between said adjoining edges and having opposite side surfaces defining a tapered wedge on said corner member, said wedge having an acute angle included between said opposite side surfaces with the taper of said wedge converging toward said external casting face of said corner member, said side surfaces being matingly and slidingly interengaged with said guide surfaces of said form panels;

a pin and slot coupling between each of said side surfaces of said tapered wedge and the adjoining guide surface of said form panel to maintain each pair of interengaged surfaces continuously and firmly interengaged upon relative movement between said surfaces during relative movement between said corner member and said form panels, each said pin and slot coupling being formed by one of said interengaged surfaces being provided with a guide slot and the other of said interengaged surfaces carrying pin means received in said guide slot, said pin means being formed to continuously maintain said interengaged surfaces firmly coupled in continuous interengaged relationship;

yolk means having a pair of end sections;

connecting means between each said end section and one of said form panels, said conecting means guidingly and positively connecting each end section to said one form panel to guide relative movements between said end sections and said form panels and prevent separation of said end sections from said form panels; and actuator means having relatively movable parts including a first part connected to the midsection of said yolk means and a second part connected to said corner member whereby relative movement between said parts causes said corner member to move inwardly relative to said form panels to shift said concrete form unit from a casting condition whereat said casting faces are contiguous with one another to a collapsed condition.

3. A concrete form unit as recited in claim 1 or 2 wherein said actuator means is an axially extensible device.

4. A concrete form unit as recited in one of claims 1 or 2 wherein said pin means includes a supporting pin and an antifriction bearing mounted on said pin.

5. A concrete form unit as recited in any one of claims 1 or 2 wherein said included angle of said tapered wedge is an angle of between 30 degrees and 60 degrees.

6. A concrete form unit as recited in claim 5 wherein said included angle is 40 degrees.

* * * * *